US007183033B2

(12) United States Patent
Shinmura et al.

(10) Patent No.: US 7,183,033 B2
(45) Date of Patent: Feb. 27, 2007

(54) CARRIER CORE MATERIAL, COATED CARRIER, TWO-COMPONENT DEVELOPING AGENT FOR ELECTROPHOTOGRAPHY, AND IMAGE FORMING METHOD

(75) Inventors: Issei Shinmura, Kashiwa (JP); Hiromichi Kobayashi, Kashiwa (JP); Tsuyoshi Itagoshi, Kashiwa (JP); Yuji Sato, Kashiwa (JP)

(73) Assignee: Powdertech Co., Ltd. (JP)

( * ) Notice: Subject to any disclaimer, the term of this patent is extended or adjusted under 35 U.S.C. 154(b) by 124 days.

(21) Appl. No.: 10/774,045

(22) Filed: Feb. 6, 2004

(65) Prior Publication Data

US 2004/0185366 A1 Sep. 23, 2004

(30) Foreign Application Priority Data

Feb. 7, 2003 (JP) ..... 2003-31408

(51) Int. Cl.
*G03G 9/107* (2006.01)
*G03G 9/113* (2006.01)

(52) U.S. Cl. ..... 430/111.33; 430/111.41; 430/111.31

(58) Field of Classification Search ..... 430/111.31, 430/111.41, 111.33; 252/62.64, 62.62
See application file for complete search history.

(56) References Cited

U.S. PATENT DOCUMENTS

| | | | | |
|---|---|---|---|---|
| 4,598,034 | A | 7/1986 | Honjo et al. | |
| 5,466,552 | A | 11/1995 | Sato et al. | |
| 5,595,850 | A | 1/1997 | Honjo et al. | |
| 5,976,747 | A | 11/1999 | Sato et al. | |
| 6,232,026 | B1 | 5/2001 | Lambert | |
| 6,316,156 | B1 * | 11/2001 | Takiguchi et al. | 430/109.4 |
| 6,372,400 | B1 | 4/2002 | Yoshizaki et al. | |

FOREIGN PATENT DOCUMENTS

| | | | | |
|---|---|---|---|---|
| EP | 0 928 998 | A1 | | 7/1999 |
| EP | 1 065 571 | A2 | | 1/2001 |
| JP | 59-111159 | A | | 6/1984 |
| JP | 59-228664 | A | | 12/1984 |
| JP | 60-0458 | A | | 1/1985 |
| JP | 59-048774 | A | | 7/1986 |
| JP | 01-223471 | A | | 9/1989 |
| JP | 2-00083 | A | | 1/1990 |
| JP | 02000083 | A | * | 1/1990 |
| JP | 02-308263 | A | | 12/1990 |
| JP | 5-197214 | A | | 8/1993 |
| JP | 6-035231 | A | | 2/1994 |
| JP | 6-051563 | A | | 2/1994 |
| JP | 3029180 | A | | 4/1995 |
| JP | 7-181744 | A | | 7/1995 |
| JP | 3238006 | A | | 11/1995 |
| JP | 08-006302 | A | | 1/1996 |
| JP | 08-022150 | A | | 1/1996 |
| JP | 3168337 | A | | 1/1996 |
| JP | 3243376 | A | | 1/1996 |
| JP | 8-069131 | A | | 3/1996 |
| JP | 8-194338 | A | | 7/1996 |
| JP | 08-202084 | A | | 8/1996 |
| JP | 09211897 | A | * | 8/1997 |
| JP | 09-236947 | A | | 9/1997 |
| JP | 09-265212 | A | | 10/1997 |
| JP | 09281752 | A | * | 10/1997 |
| JP | 10-039548 | A | | 2/1998 |
| JP | 11-190916 | A | | 7/1999 |
| JP | 2000-267360 | A | | 9/2000 |
| JP | 2002-214847 | A | | 7/2002 |
| JP | 2003-533744 | A | | 11/2003 |

OTHER PUBLICATIONS

Diamond, Arthur S & David Weiss (eds.) Handbook of Imaging Materials. New York: Marcel-Dekker, Inc. (Nov. 2001) pp. 214-222, 227,228.*

*Chemical Data Book 3*, pub. Sep. 30, 1960, "zirconium oxide" and "electric-resistance".

* cited by examiner

*Primary Examiner*—Christopher Rodee
(74) *Attorney, Agent, or Firm*—The Webb Law Firm

(57) ABSTRACT

A carrier core material for an electrophotographic developing agent, which comprises 100 parts by weight of a ferrite component represented by a formula (A) and 0.1 to 5.0 parts by weight of $ZrO_2$ that is present in the ferrite component without forming a solid solution, and which has a magnetization, at $1000(10^3/4\pi \cdot A/m)$, of 65 to 85 $Am^2/kg$ and an electrical resistance, at an applied voltage of 1000 V, of $10^5$ to $10^9$ Ω.

$$(MnO)_x(MgO)_y(Fe_2O_3)_z \quad (A)$$

wherein x, y and z are each expressed in % by mol and are numbers satisfying the conditions of $40 \leqq x \leqq 60$, $0.1 \leqq y \leqq 10$ and $x+y+z=100$. Also disclosed is a two-component developing agent comprising a coated carrier, which is obtained by coating the above carrier core material with a resin, and toner particles. Further disclosed is an image forming method comprising developing an electrostatic latent image formed by the use of an alternating electric field, with the two-component developing agent. The carrier core material and the coated carrier have high magnetization and high resistance. According to the two-component developing agent of the invention, an excellent image can be formed.

13 Claims, 1 Drawing Sheet

CARRIER CORE MATERIAL, COATED CARRIER, TWO-COMPONENT DEVELOPING AGENT FOR ELECTROPHOTOGRAPHY, AND IMAGE FORMING METHOD

BACKGROUND OF THE INVENTION

1. Field of the Invention

The present invention relates to a carrier core material for forming a resin coated carrier used when an electrostatic latent image formed by electrophotography or electrostatic printing is developed, a resin coated carrier formed from the carrier core material, a two-component developing agent for electrophotography containing the coated carrier, and an image forming method using the two-component developing agent for electrophotography.

2. Description of Related Art

An electrophotographic developing method is a method for developing a latent image formed on a photosensitive member by allowing toner particles of a developing agent to adhere to the latent image. The developing agents employable in this method are divided into two-component developing agents comprising toner particles and a carrier and mono-component developing agents using toner particles only.

As a developing method using the two-component developing agent comprising toner particles and a carrier, a cascade method was used formerly, but at the present time, a magnetic brushing method using a magnetic roll is mainly used.

The carrier in the two-component developing agent is a carrier material which is mixed and stirred with the toner particles in a development box to impart desired electric charge to the toner particles and carries the charged toner particles onto an electrostatic latent image on a surface of a photosensitive member to form a toner image.

Also after the toner image is formed, the carrier is held by a magnet, remains on the developing roll, then returns to the development box again and is mixed and stirred with new toner particles. Thus, the carrier is repeatedly used for a certain period of time.

In the two-component developing agent, the carrier has a function of imparting desired charge properties to the toner particles when mixed and stirred with the toner particles and a function of carrying the toner particles, and has good controllability in the designing of a developing agent, differently from the mono-component developing agent. Therefore, the two-component developing agent is widely used in the field of a full color developing apparatus for which high image quality is particularly required and a high-speed printing apparatus for which reliability of image retention and durability are particularly required.

In case of the two-component developing agent, accordingly, it is necessary that the desired image properties (image density, fog, white spot (attributable to carrier adhesion or carrier fly), gradation, resolution, etc.) be stably maintained without any change from the initial stage in the period of printing impression using the two-component developing agent. To meet such requirements, it naturally becomes necessary that the properties of the carrier do not vary and be stable during the period of service.

As the carrier in the two-component developing agent, an oxide-coated iron powder or a resin-coated iron powder has been conventionally used. Since such a carrier has high magnetization and good electrical conductivity, an image having good reproducibility of a solid portion can be easily obtained by the use of a two-component developing agent using the carrier.

The above-mentioned carrier, however, is heavy in its self-weight and has too high magnetization. Therefore, by the stirring stress in the development box, toner particles are fused to the surface of the iron powder carrier, that is, so-called toner spent is liable to occur. If the toner spent occurs, an effective surface area of the carrier is decreased, and thereby triboelectric effect (frictional charging power) due to the carrier and the toner particles tends to lower. In case of the resin-coated iron powder carrier, the resin material on the surface is liable to peel off by the endurance stress. Further, because the core material is electrically conductive and has low dielectric breakdown voltage, leakage of electric charge sometimes takes place. If the leakage of electric charge takes place, the electrostatic latent image formed on the photosensitive member is broken, and as a result, brush streaks are produced on the solid portion, and it becomes difficult to obtain a uniform image. For these reasons, the two-component developing agent using the oxide-coated iron powder or the resin-coated iron powder as a carrier has been less and less used.

Instead of the oxide-coated iron powder or the resin-coated iron powder, for example, a resin-coated carrier of soft ferrite, such as Cu—Zn ferrite or Ni—Zn ferrite, has been used, as described in Japanese Patent Laid-Open Publication No. 48774/1984. Because the resin-coated carrier using soft ferrite as a core material has low magnetization, a head of the developing magnetic brush can be made soft, and hence, reproducibility of vertical and horizontal lines of the resulting image becomes good. Further, because the resin-coated carrier using soft ferrite as a core material has high dielectric breakdown voltage, leakage of electric charge rarely occurs and an image of high quality can be formed.

The resin-coated carrier using soft ferrite as a core material is excellent as a carrier for the two-component developing agent as described above, but it contains, as its main component, a heavy metal such as copper or nickel. This soft ferrite is an object of regulation based on waste regulation or environmental regulation (e.g., Title 22 of the State of California, U.S.A.), and use of the soft ferrite has been avoided. Instead of the soft ferrite containing the heavy metal, eco-friendly light metal type ferrite and carrier wherein a magnetite carrier is coated with a resin have been often adopted in recent years.

Examples of such carriers include Li—Mg—Ca type ferrite described in a Japanese Patent No. 3238006, Mn—Mg—Sr type ferrite described in Japanese Patent No. 3243376 and a magnetite granulation type carrier described in Japanese Patent Laid-Open Publication No. 458/1985.

The carriers for constituting the two-component developing agents have been gradually improved with the change of times, and with the change of developing system for electrophotography, further improvement has been required for the carriers used for the two-component developing agents.

That is to say, in the conventional developing system, an analog developing system is mainly used, but recently, the developing system has been rapidly shifted to a digital developing system. Further, also in ordinary offices, networking has been promoted, and full color images have been generally employed.

Japanese Patent No. 3168377, discloses a developing system using an alternating electric field, and it is described that by virtue of the developing system using an alternating electric field, uniformity of the solid portion can be enhanced particularly in the full color machine having many image portions.

With promotion of digitalization and coloration of electrophotographs, image quality of higher level is required, and in order to obtain high resolution, the size of toner particles in the developing agent for forming an image is reduced, and recently, a toner of finely divided particles having an average particle diameter of 5 to 10 μm has been employed.

To cope with such size reduction of the toner particles and to impart desired electric charge to the toner particles by friction, a carrier having a high specific surface area becomes necessary, and the size of the carrier particle has been reduced. More specifically, spherical ferrite having an average particle diameter of 30 to 60 μm has been employed.

If the particle size of the carrier is reduced as described above, the magnetization per particle of the carrier becomes small, so that the carrier is liable to adhere to the photosensitive member. The carrier thus adhering to the photosensitive member causes a white spot on an image that is a critical defect for a high-quality image.

With regard to this point, a countermeasure that the accuracy of classification of the carrier is enhanced to decrease a content of carrier particles of small size and thereby sharpen the particle size distribution of the carrier is taken in Japanese Patent No. 3029180. However, adhesion of the carrier to the photosensitive member cannot be completely prevented only by controlling the particle size of the carrier. In particular, development of a compact and high-speed electrophotographic apparatus (i.e., digital copying machine, printer) has been rapidly promoted, but it becomes very difficult that the developing agent follows such development of the apparatus, and in the existing circumstances, a result of forming an image with no white spot has not been obtained.

There is known a developing system wherein, in order to promote a moving speed of toner particles and thereby improve uniformity of the solid and halftone portions, AC bias is superposed on DC bias when developing bias is applied to an electrostatic latent image side from a magnetic brush, i.e., a developing system using an alternating electric field. In the developing system using an alternating electric field, however, an alternating current electric field is superposed on a direct current electric field, and consequently, a strong electric field is momentarily applied to the developing agent. In such a developing system, leakage of electric charge is liable to occur, and the leakage disorders the electrostatic latent image, so that image defects such as white spots are easily produced. In the developing system using such a high electric field, further, adhesion of the carrier onto the photosensitive member, namely, carrier adhesion is apt to be induced because of injection of electric charge to the carrier.

It is known that occurrence of the carrier adhesion is attributable to the electrical resistance of the carrier, and it is also known that the carrier adhesion is caused by a relationship between magnetic force on the magnetic roll, static electricity due to the electric field and van der Waals force.

When these reasons are considered, it is necessary to use a carrier having high magnetic force in order to prevent the carrier adhesion. When an iron powder or magnetite having high magnetic force is used, the resulting carrier has high magnetic force but has low electrical resistance, and hence the carrier adhesion cannot be reduced. In order to prevent the carrier adhesion, further, it is necessary to use a carrier having high electrical resistance. When Cu—Zn ferrite or Li—Mg—Ca ferrite having high electrical resistance is used, carrier adhesion due to electrical force can be reduced, but it has low magnetic force, and hence the carrier adhesion cannot be reduced after all in case of small particle size.

In order to prevent carrier adhesion, accordingly, it becomes necessary to use a carrier having high magnetization and high electrical resistance, and it becomes necessary to satisfy both the properties at the same time.

As a method for controlling electrical resistance of a carrier, there is known a method of coating the carrier with a resin to control electrical resistance. When such a carrier is used, high electrical resistance can be maintained in a low electric field, but in a high electric field, leakage of electric charge occurs because of an influence of electrical resistance of the core material. Especially when a core material of low electrical resistance, such as an iron powder or magnetite, is used, leakage of electric charge due to an influence of electrical resistance of the core material markedly takes place. Further, even if the conventional Cu—Zn or Ni—Zn ferrite particles or the ferrite particles described in a patent document 5 (Japanese Patent No. 3168377) and a patent document 7 (Japanese Patent Laid-Open Publication No. 69131/1996), which are considered to have relatively high dielectric breakdown voltage, are used, it is difficult to obtain uniform and faithful image reproducibility in the existing circumstances.

Japanese Patent Laid-Open Publication No. 51563/1994 and Japanese Patent Laid-Open Publication No. 35231/1994 disclose that in order to perform faithful image development, it is effective to weaken magnetization of a carrier to about 30 to 150 emu/cm$^3$, and by the use of a carrier of such weak magnetization, the magnetic brush becomes soft in the magnetic field at the development pole and an image faithful to the latent image can be obtained. It is also described that rapid rise of magnetization at 0 to 100 Oe makes it possible to strengthen magnetization at 0 to 300 Oe, and thereby carrier adhesion can be reduced with enhancing image quality. Even by the use of this method, however, strength of the magnetization is not sufficient especially in the high-speed full color machine recently used. Therefore, carrier adhesion often takes place and image defects due to white spots are produced.

Japanese Patent Laid-Open Publication No. 181744/1995 discloses that a carrier for an electrophotographic developing agent, which is obtained by surface treating the carrier core particles with a coupling agent when the surfaces of the carrier core particles are coated with a partial hydrolysis sol obtained from Zr alkoxide or the like and cured, has an extremely rigid coating layer, so that the layer does not peel off during the period of service and a stable image can be formed. In the recent compact developing apparatus suffering heavy developing stress, however, the carrier core material is exposed by peeling of the coating layer in the printing impression process, and the resistance of the carrier core material due to the exposure causes fog or change of image density. Thus, sufficient durability has not been obtained.

Japanese Patent Laid-Open Publication No. 197214/1993 discloses that a carrier coated with a polyolefin resin containing carbon black, which is obtained by contacting a surface of a carrier core material with a high-activity catalyst component consisting of at least Ti or Zr in a hydrocarbon solvent and polymerizing an olefin monomer onto the surface, is excellent in durability, resistance to spent and resistance to environment. The carrier described in this publication, however, is a coated carrier obtained by coating the surface of the carrier core material with a coating resin, and in a high-speed apparatus suffering heavy stress, the carrier does not exhibit sufficient durability because of peeling of the coating resin.

OBJECTS OF THE INVENTION

It is an object of the present invention to provide a carrier core material which can form a carrier for an electrophotographic developing agent, said carrier being capable of maintaining high image qualities such that the image is excellent in faithful reproducibility of halftone, gradation, resolution and uniformity of a solid portion and free from carrier adhesion (white spot) for a long period of time, and coated carrier particles formed by the use of the carrier core material.

It is another object of the present invention to provide a two-component developing agent containing the coated carriers for an electrophotographic developing agent having the above properties.

It is a further object of the present invention to provide an image forming method using the two-component developing agent.

SUMMARY OF THE INVENTION

The carrier core material for an electrophotographic developing agent according to the present invention is a carrier core material comprising ferrite particles containing a ferrite component represented by the following formula (A):

$$(MnO)_x(MgO)_y(Fe_2O_3)_z \quad (A)$$

wherein x, y and z are each expressed in % by mol and are numbers satisfying the conditions of $40 \leqq x \leqq 60$, $0.1 \leqq y \leqq 10$ and $x+y+z=100$, and $ZrO_2$ in an amount of 0.01 to 5.0 parts by weight based on 100 parts by weight of the ferrite component, said $ZrO_2$ not forming a solid solution with the ferrite component, wherein the carrier core material has a magnetization, at 1000 ($10^3/4\pi \cdot A/m$), of 65 to 85 $Am^2/kg$ and an electrical resistance, at an applied voltage of 1000 V, of $10^5$ to $10^9$ Ω.

The carrier core material for an electrophotographic developing agent according to the present invention is preferably a carrier core material wherein the surfaces of the ferrite particles have been oxidized and the ferrite particles have an electrical resistance, at an applied voltage of 1000 V, of $10^6$ to $10^{12}$ Ω.

The coated carrier according to the present invention is a coated carrier comprising:

a carrier core material which comprises ferrite particles containing a ferrite component represented by the above formula (A) and $ZrO_2$ in an amount of 0.01 to 5.0 parts by weight based on 100 parts by weight of the ferrite component, said $ZrO_2$ not forming a solid solution with the ferrite component, and a resin coating layer formed on the surface of the core material, wherein the coated carrier has a magnetization, at 1000 ($10^3/4\pi \cdot A/m$), of 65 to 85 $Am^2/kg$ and an electrical resistance, at an applied voltage of 1000 V, of not less than $10^7$ Ω.

The two-component developing agent for electrophotography according to the present invention comprises the above-mentioned coated carrier and toner particles having an average particle diameter of 3 to 15 μm.

The image forming method according to the present invention comprises developing an electrostatic latent image formed by the use of an alternating electric field, with the above-mentioned two-component developing agent for electrophotography.

According to the present invention to the Mn—Mg type ferrite having prescribed composition, zirconium oxide ($ZrO_2$) in a given amount and if necessary bismuth oxide ($Bi_2O_3$) are added, whereby magnetization and resistance can be independently controlled though they cannot be independently controlled in the conventional carriers, and hence a ferrite carrier core material having high magnetization and high resistance can be obtained.

By the use of the two-component developing agent prepared using the coated carrier wherein the surface of the ferrite carrier core material has been coated with a resin, an image can be efficiently formed in the image forming method using an alternating electric field.

DETAILED DESCRIPTION OF THE INVENTION

Figure 1:
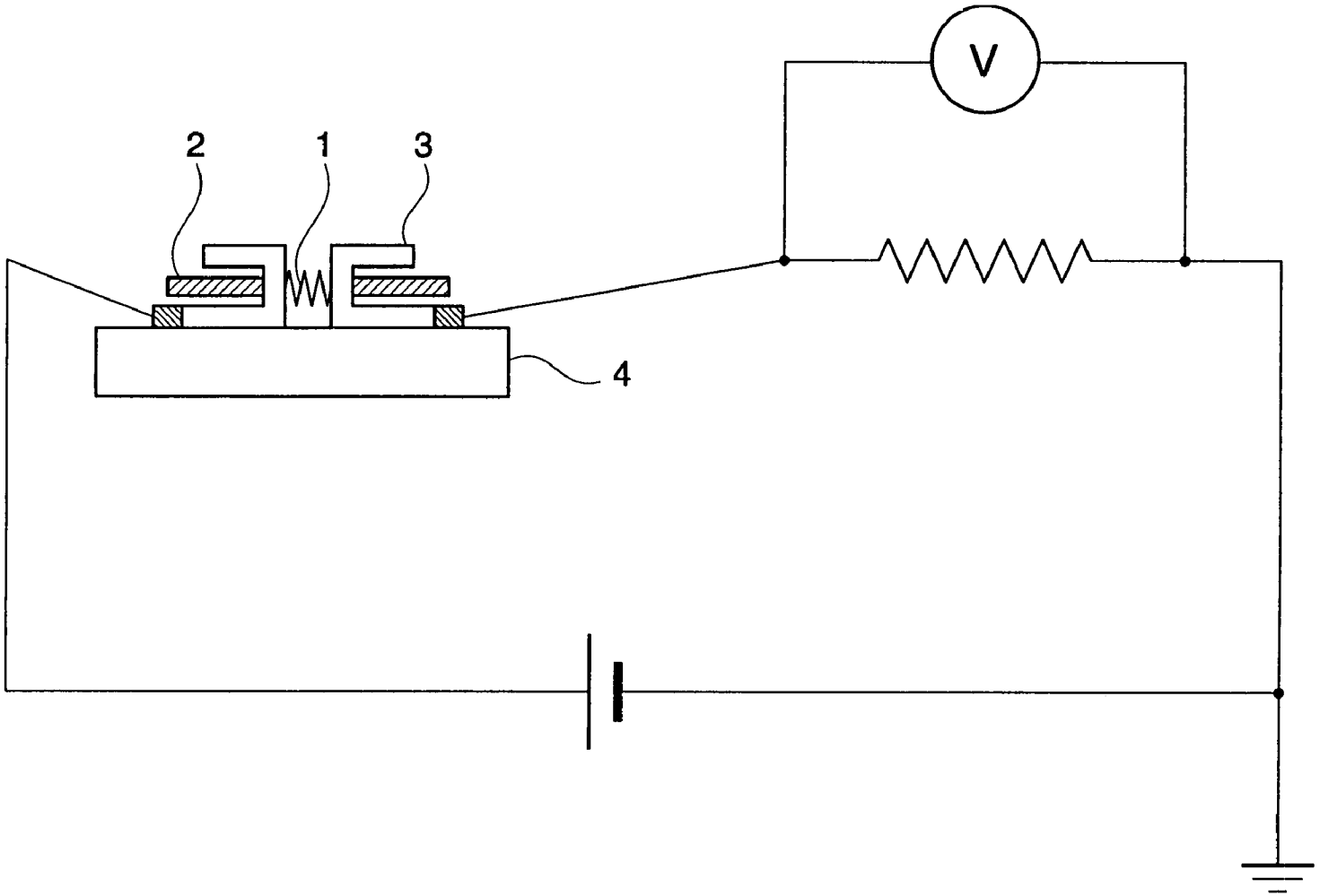
FIG. 1 is a view showing an electrical resistance measuring machine for a ferrite carrier.

The carrier core material for an electrophotographic developing agent, the coated carrier, the two-component developing agent and the image forming method according to the present invention are described in detail hereinafter.

The carrier core material for an electrophotographic developing agent according to the invention comprises a specific ferrite component and $ZrO_2$ that is contained in the ferrite component without forming a solid solution with the ferrite component.

The ferrite component for forming the carrier core material for an electrophotographic developing agent according to the invention is represented by the following formula (A):

$$(MnO)_x(MgO)_y(Fe_2O_3)_z \quad (A)$$

wherein x, y and z are each expressed in % by mol and are numbers satisfying the conditions of $40 \leqq x \leqq 60$, $0.1 \leqq y \leqq 10$ and $x+y+z=100$.

In the formula (A), x is preferably a number of $40 \leqq x \leqq 50$, particularly preferably a number of $46 \leqq x \leqq 50$.

If x in the formula (A) is more than 60 or less than 40, the calcining atmosphere in the preparation process is limited in order that the carrier core material of the invention exhibits excellent magnetic properties, and thereby electrical resistance of the carrier core material is lowered. As a result, excellent magnetic properties and excellent electrical resistance cannot be obtained at the same time.

In the formula (A), y is a number of $0.1 \leqq y \leqq 10$, preferably a number of $0.1 \leqq y \leqq 7.0$, particularly preferably a number of $0.1 \leqq y \leqq 5.0$. If y in the formula (A) is less than 0.1, surface properties and shape are deteriorated, and hence an excellent spherical carrier core material cannot be obtained. If y exceeds 10, electrical resistance of the carrier core material becomes high, but magnetic properties tend to be lowered.

Because of $x+y+z=100$ in the formula (A), z is usually a number of $30<z<59.9$, preferably a number of $40 \leqq z \leqq 59.9$, particularly preferably a number of $45 \leqq z \leqq 53.9$. In the present invention, z is preferably a value as close as possible to 50.

In the carrier core material of the invention, $ZrO_2$ is contained in an amount of 0.01 to 5.0 parts by weight, preferably 0.05 to 3.0 parts by weight, particularly preferably 0.1 to 2.0 parts by weight, based on 100 parts by weight of the ferrite component. When $ZrO_2$ is contained in this amount, the carrier core material maintains aimed magnetization and has high electrical resistance. If the content of $ZrO_2$ in the carrier core material is less than 0.01 part by weight, a carrier core material having an electrical resistance desired in the present invention cannot be obtained. If the content thereof exceeds 5.0 parts by weight, saturated magnetization is lowered and residual magnetization and coercive force are increased, resulting in system troubles, such as carrier fly and carrying error.

In the carrier core material of the invention, $Bi_2O_3$ is contained in an amount of usually 0.1 to 5.0 parts by weight based on 100 parts by weight of the ferrite component. The content of $Bi_2O_3$ is preferably 0.1 to 3.0 parts by weight, particularly preferably 0.1 to 2.0 parts by weight, based on 100 parts by weight of the ferrite component. If the content of $Bi_2O_3$ is less than 0.1 part by weight, an effect of high resistance is not exerted. If the content thereof exceeds 5.0 parts by weight, lowering of magnetization or marked deterioration of surface properties or shape takes place. By the addition of $Bi_2O_3$ in the above amount, a carrier core material having high magnetization and high electrical resistance can be more easily obtained.

The carrier core material of the invention may contain both of $ZrO_2$ and $Bi_2O_3$. When both of $ZrO_2$ and $Bi_2O_3$ are contained in the carrier core material of the invention, the amount of $ZrO_2$ and the amount of $Bi_2O_3$ are controlled so that the total amount should be in the range of usually 0.15 to 5.0 parts by weight, preferably 0.15 to 3.0 parts by weight, particularly preferably 0.2 to 2.0 parts by weight.

When the carrier core material of the invention contains both of $ZrO_2$ and $Bi_2O_3$, $ZrO_2$ and $Bi_2O_3$ are used in such amounts that the weight ratio between $ZrO_2$ and $Bi_2O_3$ is in the range of usually 10:1 to 1:10, preferably 3:1 to 1:3.

As components which can increase the resistance of the resulting ferrite by the addition to the ferrite component, $Li_2O$, CaO, $SiO_2$, BaO and the like are known. If these components are added to the ferrite, they form a solid solution with the ferrite, whereby the electrical resistance of the ferrite is increased but the magnetization thereof is lowered. $ZrO_2$, however, can be finely dispersed in the ferrite component represented by the aforesaid formula (A) without forming a solid solution with the ferrite component. When a proper amount of $ZrO_2$ is added to the ferrite component and finely dispersed in the ferrite component as described above, the resistance of the carrier material of the invention can be increased while high magnetization is maintained. By adding $Bi_2O_3$ in a proper amount to the ferrite component containing $ZrO_2$, the function of $ZrO_2$ becomes more pronounced.

In the ferrite component represented by the formula (A), the above $ZrO_2$ and $Bi_2O_3$ are dispersed in the form of fine particles having a size of usually about 0.1 to 7 μm, preferably about 0.1 to 5 μm.

The $ZrO_2$ is homogeneously scattered inside the particle and has high electrical resistance with maintaining magnetization. Especially by the addition of a proper amount of $Bi_2O_3$ in addition to $ZrO_2$, the $ZrO_2$ comes to be present in a higher concentration in the vicinity of the surface of the ferrite carrier particle, and thereby a ferrite carrier having high magnetization and high electrical resistance can be obtained.

The ferrite carrier core material has an electrical resistance of $10^5$ to $10^9$ Ω, preferably $10^6$ to $10^9$ Ω, when a voltage of 1000 V is applied to the core material.

It is preferable that the surface of the ferrite carrier core material has been subjected to oxide coating treatment. According to X-ray diffractometry, it can be confirmed that, by virtue of the oxide coating treatment, a layer having a high concentration of $Fe_2O_3$ other than a spinel structure is formed in a thickness of several μm from the outermost surface of the ferrite carrier core material toward the center. By the formation of such a layer, dielectric breakdown of the ferrite carrier core material does not occur even when a high voltage is applied, and high electrical resistance is exhibited. The layer having a high concentration of $Fe_2O_3$ is preferably formed in a thickness (depth) of not less than 50 nm from the surface of the ferrite carrier core material, and the depth is particularly preferably in the range of 0.1 to 0.3 μm. The depth of the layer having a high concentration of $Fe_2O_3$ preferably reaches 1/1000 to 1/5 of the particle diameter from the particle surface.

The ferrite core material whose particle surface has been subjected to oxide coating has an electrical resistance, as measured under application of a voltage of 1000 V, of usually $10^6$ to $10^{12}$ Ω, preferably $10^7$ to $10^{12}$ Ω.

In the present invention, the electrical resistance of the carrier core material and the coated carrier can be measured by the use of such an electrical resistance, measuring machine as shown in FIG. 1. Referring to FIG. 1, numeral 1 designates a sample (carrier core material, coated carrier), numeral 2 designates a magnetic pole, numeral 3 designates a brass plate (electrode), and numeral 4 designates a fluororesin plate. The electrical resistance in the present invention is measured by placing 200 mg of a sample in this device.

That is to say, N pole and S pole are allowed to face each other at a magnetic pole distance of 2.0 mm was shown in FIG. 1, and 200 mg of a sample is weighed and filled between non-magnetic parallel flat plate electrodes (area: 10×40 mm). The magnetic poles (surface magnetic flux density: 1.5 T, area of facing electrodes: 10×30 mm) are fitted to the parallel flat plate electrodes to hold the sample between the electrodes. Then, electrical resistance of the carrier at an applied voltage of 1000 V is measured using an insulation electrical resistance meter or an ammeter.

The magnetization of the carrier core material of the invention at $1000(10^3/4\pi \cdot A/m)$ is in the range of usually 65 to 85 $Am^2/kg$, preferably 70 to 80 $Am^2/kg$.

The residual magnetization (Mr) of the carrier core material of the invention at $1000(10^3/4\pi \cdot A/m)$ is usually not more, than 5 $Am^2/kg$, preferably not more than 2 $Am^2/kg$, and the coercive force (Hc) thereof is usually not more than $20(10^3/4\pi \cdot A/m)$, preferably not more than $15(10^3/4\pi \cdot A/m)$. If the residual magnetization or the coercive force is too high, the developing agent has poor fluidity, and rise of frictional charging to the toner becomes bad. As a result, a phenomenon of toner fly or fog is liable to occur.

In the present invention, the magnetic properties of the carrier core material and the coated carrier can be measured by the use of an integration type B—H tracer (BHU-60 type, manufactured by Riken Denshi Co., Ltd.). In the present invention, the magnetic properties can be calculated from a hysteresis loop obtained by filling about 1 g of a sample in the aforesaid device.

That is to say, a measuring sample is placed in a cell having an inner diameter of 7 mm and a height of 5 mm, and the cell is set in the aforesaid device. In the measurement, a magnetic field is applied to the measuring sample, and the magnetic field is swept to $3000(10^3/4\pi \cdot A/m)$. Then, the applied magnetic field is reduced to form a hysteresis loop, and from the hysteresis loop, magnetization, residual magnetization and coercive force at $1000(10^3/4\pi \cdot A/m)$ can be calculated.

If the magnetization of the carrier core material of the invention, as measured in the above manner, is less than 65 $Am^2/kg$, carrier adhesion is liable to take place though reproducibility of halftone or gradation becomes relatively good. If the magnetization exceeds 85 $Am^2/kg$, a head of a magnetic brush becomes hard, and hence brush streaks are easily produced. Moreover, good gradation and resolution cannot be obtained, and an image of high quality cannot be obtained.

The carrier core material having the above composition has a volume average particle diameter of usually 20 to 50 μm, preferably 22 to 45 μm. In the carrier core material, the content of finely divided particles having a particle diameter of less than 15 μm is usually not more than 3% by volume, preferably not more than 1% by volume, and the content of coarse particles having a particle diameter of more than 60 μm is usually not more than 3% by volume, preferably not more than 1% by volume.

The carrier core material of the invention has a BET specific surface area of usually 200 to 2000 $m^2/g$, preferably 400 to 1600 $m^2/g$.

In the electrophotographic carrier of the invention, a resin coating layer is formed on the surface of the carrier core material comprising the ferrite component. As the coating resin for forming the resin coating layer, any of various resins heretofore known is employable. Examples of such coating resins include fluororesin, acrylic resin, epoxy resin, polyester resin, fluorine-acrylic resin, fluorine-epoxy resin, acrylic-styrene resin, silicone resin, and modified silicone resin modified with acrylic resin, polyester resin, epoxy resin, alkyd resin, urethane resin, fluororesin or the like.

The resin is used in an amount of usually 0.01 to 10.0% by weight, preferably 0.3 to 7.0% by weight, more preferably 0.5 to 3.0% by weight, based on the carrier core material. If the coating amount is less than 0.01% by weight, it is difficult to form a uniform coating layer on the surface of the carrier core material. If the coating amount exceeds 10.0% by weight, aggregation of carrier particles is liable to take place to cause lowering of productivity, such as poor yield, and to cause change of properties of the developing agent, such as fluidity in the developing apparatus or quantity of electrostatic charge.

The resin coating layer formed on the carrier core material receives heavy stress by stirring of a toner or collision with a doctor blade in the developing apparatus, so that the layer is liable to peel off or is markedly abraded. In the developing apparatus, a phenomenon that toner particles adhere to the carrier surface, i.e., spent phenomenon, is also liable to take place.

Accordingly, the resin used for coating the carrier core material is preferably a resin capable of keeping stable properties of the developing agent for a long period of time and hardly influenced by the severe conditions in the developing apparatus. As the resin having such properties, a resin having a structure represented by the following formula (I) and/or (II) is particularly preferable. By the use of a resin having such a structure, the coated carrier not only has excellent abrasion resistance, peel resistance and spent resistance but also tends to be water-repellent.

(I)

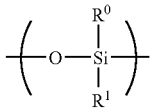

(II)

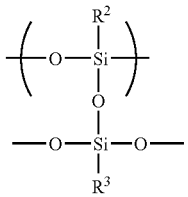

In the formulas (I) and (II), $R^0$, $R^1$, $R^2$ and $R^3$ are each independently a hydrogen atom, a halogen atom, a hydroxyl group, a methoxy group, an alkyl group of 1 to 4 carbon atoms or a phenyl group.

The resin having a structure represented by the formula (I) or (II) is, for example, a straight silicone resin, and this resin may be modified with another organic group. Examples of the modified resins include an acrylic-modified silicone resin, an epoxy-modified silicone resin and a fluorine-modified silicone resin. These resins can be used singly or in combination. In case of using these resins in combination, polarity imparted to the carrier by these resins should be taken into consideration. In order to enhance adhesion properties of the resin, a crosslinking agent of oxime type or the like can be added.

In the resin for coating the carrier core material, a silane coupling agent is preferably contained as a charging controlling agent. When a resin coating layer is formed in such a manner that the exposed area of the core material becomes relatively small, the charging ability of the electrophotographic coated carrier is sometimes lowered, and in this case, use of the silane coupling agent makes it possible to control the charging ability of the electrophotographic coated carrier. The type of the silane coupling agent used for controlling the charging ability is not specifically restricted, but for a coated carrier used when a negative-polarity toner is used, an aminosilane coupling agent is preferable, and for a coated carrier used when a positive-polarity toner is used, a fluorosilane coupling agent is preferable. The silane coupling agent is used in an amount of usually 0.1 to 100 parts by weight, preferably 0.1 to 50 parts by weight, based on 100 parts by weight of the resin used as the coating agent.

In the present invention, conductive fine particles can be added to the coating resin of the coated carrier to control electrical resistance of the coated carrier. If the coating amount of the resin in the electrophotographic coated carrier of the invention is large, the electrical resistance of the coated carrier is sometimes increased excessively, and in this case, the developing power of the developing agent is occasionally lowered. In such a case, the electrical resistance of the coated carrier can be controlled by adding a small amount of conductive fine particles to the coating resin of the coated carrier. The conductive fine particles, however, are electrically conductive, and their electrical resistance is lower than that of the coating resin or the core material, so that if the amount of the conductive fine particles added is too large, leakage of electric charge from the coated carrier attributable to the conductive fine particles sometimes occurs. Therefore, the amount of the conductive fine particles added is in the range of usually 0.25 to 20.0% by weight, preferably 0.5 to 15.0% by weight, particularly preferably 1.0 to 10.0% by weight, based on the solid content of the coating resin.

Examples of the conductive fine particles employable in the invention include conductive carbon and oxides such as titanium oxide and tin oxide. These can be used singly or in combination.

The coated carrier of the invention is formed from the carrier core material comprising the ferrite component and the resin coating layer formed on the surface of the carrier core material.

The magnetic properties of the coated carrier of the invention can be measured in the same manner as in the measurement of magnetic properties of the carrier core material. The magnetization (Ms) of the coated carrier of the invention at $1000(10^3/4\pi \cdot A/m)$ is in the range of 65 to 85 $Am^2/kg$, preferably 70 to 80 $Am^2/kg$.

If the magnetization of the coated carrier of the invention as measured in the aforesaid manner is less than 65 $Am^2/kg$, carrier adhesion is liable to take place though reproducibility of halftone or gradation becomes relatively good. If the magnetization exceeds 85 $Am^2/kg$, a head of a magnetic brush becomes hard, and hence brush streaks are easily produced. Moreover, good gradation and resolution cannot be obtained, and an image of high quality cannot be obtained.

The residual magnetization (Mr) of the coated carrier of the invention at $1000(10^3/4\pi \cdot A/m)$ is usually not more than 5 $Am^2/kg$, preferably not more than 3 $Am^2/kg$, and the coercive force (Hc) thereof is usually not more than $20(10^3/4\pi \cdot A/m)$, preferably not more than $15(10^3/4\pi \cdot A/m)$. If the residual magnetization or the coercive force is too high, the developing agent has poor fluidity, and rise of frictional charging to the toner becomes bad. As a result, a phenomenon of toner fly or fog is liable to occur.

The coated carrier of the invention has an electrical resistance of not less than $10^7$ Ω, preferably $10^7$ to $10^{13}$ Ω, particularly preferably $10^8$ to $10^{13}$ Ω, when a voltage of 1000 V is applied to the coated carrier.

The coated carrier has an average particle diameter of usually 20 to 50 μm, preferably 22 to 45 μm. The coated carrier has a 635-mesh passing ratio of usually not more than 10% by weight. The 635-mesh passing ratio of the coated carrier is preferably not more than 3% by weight, particularly preferably not more than 1% by weight.

If the average particle diameter of the coated carrier of the invention exceeds 50 μm, unevenness of solid or nonuniformity of halftone tends to occur, and it becomes difficult to obtain high image quality. If the average particle diameter is less than 20 μm carrier adhesion is liable to take place. By uniformalizing the particle diameters so that the 635-mesh passing ratio of the coated carrier of the invention should not exceed 10% by weight, adhesion of the coated carrier to the photosensitive member can be prevented, and image defects due to white spots, which are liable to be produced particularly in case of a full color image, can be effectively prevented.

In the present invention, the average particle diameters of the carrier core material and the coated carrier are values measured by the use of a MICROTRAC particle size analyzer (Model 9320-X100) manufactured by Nikkiso Co., Ltd. The 635-mesh passing ratio is measured by a q/m meter manufactured by EPPING GmBH. using a 635-mesh wire cloth. That is to say, 2 $cm^3$ of a coated carrier is filled in a measuring cell using a 635-mesh wire cloth and is sucked for 90 seconds at a suction force of 1050±5 mbar to determine a loss in weight after the suction, and the loss in weight is taken as a 635-mesh passing ratio.

The electrophotographic carrier of the invention can be prepared by mixing a manganese compound, a magnesium compound, an iron compound, a zirconium compound, and if necessary, a bismuth compound in the aforesaid amounts in terms of an oxide, and then calcining the mixture.

Examples of the manganese compounds employable herein include MnO, $MnO_2$, $MnCO_3$ and $Mn_3O_4$. Examples of the magnesium compounds employable herein include MgO, $Mg(OH)_2$ and $MgCO_3$. As the iron compound, not only iron oxide such as $Fe_2O_3$ but also a substance obtained by roasting an acid cleaning liquid of steel or a substance obtained by roasting natural magnetite is employable. As the zirconium compound, $ZrO_2$ or the like is employable. As the bismuth compound, $Bi_2O_3$ or the like is employable.

Although the starting material components contain a little amount of impurities in addition to the main elements, the impurities of less than 100 ppm in each starting material does not exert any particular influence on the properties of the carrier core material and the coated carrier of the invention.

The above-mentioned starting material components are weighed, pulverized and mixed. The pulverization and mixing may be carried out by a wet process or a dry process. In case of a wet process, a wet ball mill, a wet oscillating mill or the like is employable. The pulverization time in the pulverization mixing process is usually not shorter than 1 hour, preferably 1 to 20 hours.

The resulting pulverizate is dried and then temporarily calcined by a rotary kiln or the like.

The temporary calcining is carried out by maintaining the pulverizate at a temperature of usually 700 to 1200° C., preferably 800 to 1000° C., for usually 0.1 to 5 hours, preferably 0.5 to 3 hours. By the temporary calcining, apparent density of the resulting carrier can be increased. Therefore, when an electrophotographic carrier having low apparent density is to be obtained, this temporary calcining can be omitted.

After the temporary calcining is carried out in the above manner, the temporarily calcined product is pulverized again. This pulverization is preferably carried out by a wet process, and usually, the temporarily calcined product is dispersed in water and pulverized. For the pulverization, a wet ball mill, a wet oscillating mill or the like is employable. The pulverization is carried out in such a manner that the resulting pulverizate has a particle diameter (average value) of usually not more than 15 μm, preferably not more than 5 μm, particularly preferably not more than 3 μm, most preferably not more than 2 μm. In the wet pulverization process using a wet ball mill, a wet oscillating mill or the like, the pulverization time is in the range of usually 0.5 to 20 hours, preferably 1 to 10 hours.

After the pulverization is carried out in the above manner, a dispersant, a binder, etc. are added when needed. Then, by the use of a drying-granulating apparatus such as a spray dryer, removal of water content, control of particle size and drying are carried out.

In the present invention, the resulting granulate is then calcined. The calcining is carried out by maintaining the granulate at a temperature of usually 1000 to 1500° C., preferably 1100 to 1350° C. Under such calcining conditions, calcining is carried out for a period of usually 1 to 24 hours, preferably 2 to 10 hours.

The oxygen concentration in the calcining process has an influence on the oxidized state of the surface of the resulting ferrite carrier, so that in the calcining process, the oxygen concentration in the calcining apparatus is controlled to be in a given range. In the, present invention, the oxygen concentration in the calcining apparatus is desirably controlled to be usually not more than 5% by volume, preferably 0 to 3% by volume, particularly preferably 0.1 to 1% by volume.

Although the carrier core material obtained as above can be coated as such with a resin, the carrier core material is heated in the atmosphere to perform oxide coating treatment and thereby control electrical resistance. The oxide coating treatment is carried out by heating the carrier core material in the atmosphere at a temperature of usually 300 to 700° C., preferably 450 to 650° C., using a conventional rotary electric furnace, a batch type electric furnace or the like. If the temperature is lower than 300° C., the effect of the oxide coating treatment is not exhibited markedly. If the temperature is higher than 700° C., magnetization is lowered.

By treating the carrier core material under the above conditions for 1 to 180 minutes, preferably 10 to 120 minutes, the carrier core material has higher electrical resistance. Prior to the oxide coating treatment, the carrier core material of the invention may be subjected to reduction treatment at a temperature of not higher than 250° C., when needed.

The calcined product obtained as above is then crushed and classified. Examples of the classification methods include air classification, sieve filtration and sedimentation. The particle diameter of the carrier core material is preferably controlled to be in the desired range by these classification methods.

In order to remove particles of low magnetization, it is preferable to carry out magnetic separation before or after the classification.

The carrier core material prepared as above is then coated with a resin, whereby a coated carrier is prepared. Examples of the coating resins employable herein include the aforesaid resins.

For coating the carrier core material with the coating resin, publicly known methods, such as a brushing method, a dry method, a spray drying method using a fluidized bed, a rotary drying method and a liquid immersion drying method using a universal stirrer, are employable. In order to increase a coating ratio, the method using a fluidized bed is preferable.

When the carrier core material is subjected to baking after the resin coating, the baking may be carried out by an external heating method or an internal heating method. For example, a fixed or fluid electric furnace, a rotary electric furnace or a burner furnace is employable, or microwave may be used for the baking without using such furnaces.

The baking temperature varies depending upon the type of the resin used, but it is necessary to heat the carrier at a temperature of not lower than a melting point or a glass transition temperature of the resin used. When a thermosetting resin or a condensation crosslinking type resin is used, the heating temperature is preferably maintained until the resin is sufficiently cured. After the coating layer is formed in this manner, the coated carrier is crushed and classified, when needed. As the classification method, conventional air classification, mesh filtration, sedimentation or the like is employable.

The two-component developing agent of the present invention comprises the above-described coated carrier and toner particles. The toner particles for use in the invention include grinded toner particles prepared by grinding and polymerized toner particles prepared by polymerization. In the present invention, toner particles obtained by any of those processes are employable.

The grinded toner particles can be obtained by, for example, a process comprising sufficiently mixing a binding resin, a charging controlling agent and a colorant by a mixing machine such as a HENSCHEL MIXER, melt kneading the mixture by a twin-screw extruder or the like, then cooling, pulverizing, classifying, adding external additives and mixing them by a mixer or the like.

The binding resin for forming the toner particles is not specifically restricted, but there can be mentioned, for example, polystyrene, chloropolystyrene, a styrene/chlorostyrene copolymer, a styrene/acrylic acid ester copolymer, a styrene/methacrylic acid copolymer, a rosin-modified maleic acid resin, an epoxy resin, a polyester resin and a polyurethane resin. These resins are used singly or in combination.

As the charging controlling agent, an arbitrary agent is employable. Examples of the charging controlling agents for positive charge toners include nigrosine type dyes and quaternary ammonium salts. Examples of the charging controlling agents for negative charge toners include metal-containing monoazo dyes.

As the colorant (coloring material), a dye and/or a pigment heretofore known is employable. Examples of such colorants include carbon black, phthalocyanine blue, permanent red, chrome yellow and phthalocyanine green. In addition to the above components, external additives, such as a silica powder and titania, can be added to the toner particles in order to improve fluidity and aggregation resistance of the toner.

The polymerized toner particles are toner particles prepared by a known process, such as suspension polymerization or emulsion polymerization. The polymerized toner particles can be obtained by, for example, a process comprising mixing and stirring a colorant dispersion wherein a colorant is dispersed in water using a surface active agent, a polymerizable monomer, a surface active agent and a polymerization initiator in an aqueous medium to emulsify the polymerizable monomer in the aqueous medium, then further stirring and mixing the emulsion to perform polymerization, and adding, for example, a salting-out agent to salt out polymer particles, followed by filtering, washing and drying the resulting particles. Thereafter, external additives are added to the dried toner particles, when needed.

In the preparation of the polymerized toner particles, a fixing property improver and a charging controlling agent can be added in addition to the polymerizable monomer, the surface active agent, the polymerization initiator and the colorant, whereby various properties of the resulting polymerized toner particles can be controlled or improved. Moreover, a chain transfer agent can be used to improve dispersibility of the polymerizable monomer in the aqueous medium and to control molecular weight of the resulting polymer.

The polymerizable monomer used for preparing the polymerized toner particles is not specifically restricted, but there can be mentioned, for example, styrene and its derivatives; ethylenically unsaturated monoolefins, such as ethylene and propylene; halogenated vinyls, such as vinyl chloride; vinyl esters, such as vinyl acetate; and α-methylene aliphatic monocarboxylic acid esters, such as methyl acrylate, ethyl acrylate, methyl methacrylate, ethyl methacrylate, 2-ethylhexyl methacrylate, dimethyl aminoacrylate and diethyl aminomethacrylate.

As the colorant (coloring material) used for preparing the polymerized toner particles, a dye and/or a pigment heretofore known is employable. Examples of such colorants include carbon black, phthalocyanine blue, permanent red, chrome yellow and phthalocyanine green. The surface of the colorant may be modified with a surface modifier such as a silane coupling agent or a titanium coupling agent.

As the surface active agent used for preparing the polymerized, toner particles, an anionic surface active agent, a cationic surface active agent, an amphoteric surface active agent or a nonionic surface active agent is employable.

Examples of the anionic surface active agents include fatty acid salts, such as sodium oleate and castor oil; alkylsulfuric acid esters, such as sodium laurylsulfate and ammonium laurylsulfate; alkylbenzenesulfonic acid salts, such as sodium dodecylbenzenesulfonate; alkylnaphthalenesulfonic acid salts; alkylphosphoric acid ester salts; naphthalenesulfonic acid formalin condensate; and polyoxyethylene alkylsulfuric acid ester salts.

Examples of the nonionic surface active agents include polyoxyethylene alkyl ethers, polyoxyethylene fatty acid esters, sorbitan fatty acid esters, polyoxyethylene alkylamine, glycerol, fatty acid esters, and an oxyethylene/oxypropylene block polymer.

Examples of the cationic surface active agents include alkylamine salts, such as laurylamine acetate; and quaternary ammonium salts, such as lauryltrimethylammonium chloride and stearyltrimethylammonium chloride.

Examples of the amphoteric surface active agents include aminocarboxylic acid salts and alkylamino acids.

The surface active agent is used in an amount of usually 0.01 to 10% by weight based on the polymerizable monomer. The amount of the surface active agent has an influence not only on the dispersion stability of the monomer but also on the environmental dependence of the resulting polymerized toner particles. Therefore, it is preferable to use the surface active agent in such an amount that the dispersion stability of the monomer is ensured and the surface active agent does not exert an excess influence on the environmental dependence of the polymerized toner particles.

In the preparation of the polymerized toner particles, a polymerization initiator is usually used. The polymerization initiator includes a water-soluble polymerization initiator and an oil-soluble polymerization initiator, and in the present invention, any of them is employable. Examples of the water-soluble polymerization initiators employable in the invention include persulfuric acid salts, such as potassium persulfate and ammonium persulfate, and water-soluble peroxide compounds. Examples of the oil-soluble polymerization initiators include azo compounds, such as azobisisobutyronitrile, and oil-soluble peroxide compounds.

When the chain transfer agent is used in the invention, there can be mentioned, as examples thereof, mercaptans, such as octylmercaptan, dodecylmercaptan and tert-dodecylmercaptan, and carbon tetrabromide.

When the polymerized toner particles used in the invention contain a fixing property improver, there can be mentioned, as examples of the fixing property improvers, natural waxes, such as carnauba wax, and olefin waxes, such as polypropylene and polyethylene.

When the polymerized toner particles used in the invention contain a charging controlling agent, the type of the charging controlling agent is not specifically restricted, and examples thereof include nigrosine type dyes, quaternary ammonium salts, organometallic complexes and metal-containing monoazo dyes.

Examples of the external additives used for improving fluidity of the polymerized toner particles include silica, titanium oxide, barium titanate, fluorine fine particles and acrylic fine particles. These external additives can be used singly or in combination.

Examples of the salting-out agents used for separating the polymer particles from the aqueous medium in the preparation of the polymerized toner particles include metal salts, such as magnesium sulfate, aluminum sulfate, barium chloride, magnesium chloride, calcium chloride and sodium chloride.

The average particle diameter of the toner particles prepared as above is in the range of 3 to 15 μm, preferably 5 to 10 μm. The polymerized toner particles have higher particle uniformity than the grinded toner particles. If the average particle diameter of the toner particles is less than 3 μm, charging ability is lowered, and fog or toner fly is liable to occur. If the average particle diameter of the toner particles exceeds 15 μm, image quality may be deteriorated.

By mixing the coated carrier with the toner particles, the developing agent for electrophotography according to the present invention can be obtained. The content of the toner particles in the developing agent, namely, toner concentration, is preferably in the range of 5 to 15%. If the toner concentration is less than 5%, it is difficult to obtain desired image density. If the toner concentration exceeds 15%, toner fly or fog is liable to occur.

The two-component developing agent prepared as above can be used in an electrophotographic apparatus (copy machine, printer, Fax, printing machine, etc.) of such a developing system that an electrostatic latent image formed on a photosensitive member having an organic photoconductive layer is reversely developed. This developing agent is particularly suitable for an image forming method wherein a latent image is developed by the toner particles with applying a bias electric field having an alternating current component and a direct current component to the developing portion in the developing region of a magnetic brush that faces the photosensitive member for holding the latent image.

The two-component developing agent of the invention can be used in the above-mentioned developing system. The two-component developing agent of the invention is particularly favorable as a developing agent for a full color machine using the aforesaid alternating electric field.

According to the present invention, a carrier core material capable of forming a carrier for an electrophotographic developing agent, said carrier being capable of maintaining high image qualities such that the image is excellent in faithful reproducibility of halftone, gradation, resolution and uniformity of a solid portion and free from carrier adhesion (white spot) for a long period of time, and coated carrier particles are obtained.

The carrier core material and the coated carrier of the invention comprise ferrite having prescribed composition and $ZrO_2$ and if necessary $Bi_2O_3$, said $ZrO_2$ and $Bi_2O_3$ being dispersed in the ferrite without forming a solid solution with the ferrite. The carrier core material and the coated carrier have high magnetization and high electrical resistance at the same time.

The two-component developing agent of the present invention comprises the coated carrier and toner particles. By the use of the two-component developing agent, an excellent image can be formed even in a developing system using an alternating electric field.

EXAMPLES

The present invention is further described with reference to the following examples, but it should be construed that the invention is in no way limited to those examples.

Example 1

MnO of 49.9% by mol, MgO of 0.1% by mol and $Fe_2O_3$ of 50.0% by mol were weighed, and based on 100 parts by weight of the total of these metal oxides, 1.5 parts by weight of $ZrO_2$ and 0.5 part by weight of $Bi_2O_3$ were weighed and added.

The mixture was blended and pulverized by a wet ball mill for 5 hours and then maintained at 950° C. for 1 hour in a rotary kiln to perform temporary calcining.

The temporarily calcined product was pulverized by a wet ball mill for 7 hours to obtain particles having an average particle diameter of 1.5 μm.

To the resulting slurry, a dispersant and a binder were added in proper amounts. Then, the mixture was granulated and dried by a spray dryer. Thereafter, the granulate was held in an electric furnace for 6 hours under the conditions of a temperature of 1250° C. and an oxygen concentration of 0.3% to perform calcining.

The calcined product was crushed and then classified to perform particle size control, whereby ferrite particles were obtained. The ferrite particles thus obtained were held for 1 hour in a rotary atmospheric furnace maintained at 500° C. to subject the surfaces of the ferrite particles to oxide coating treatment.

The ferrite particles having been subjected to the oxide coating treatment were then subjected to magnetic separation and mixing to obtain a carrier core material. The average particle diameter of the carrier core material was 32.9 μm.

Separately, a coating resin was prepared in the following manner. 100 Parts by weight of chlorosilane (mixture of 9 mol of $CH_3SiCl_3$ and 1 mol of $(CH_3)_2SiCl_2$) were dropwise added to a mixture of 300 parts by weight of water, 500 parts by weight of toluene and 100 parts by weight of lower alcohol (butanol/propyl alcohol mixed liquid), and they were mixed. Then, the mixture was subjected to liquid separation, and the aqueous layer was removed. Then, the low-boiling point component was further removed to obtain a 20% silicone resin of the following formulas (I) and (II). Based on 100 parts by weight of the solid content of the silicone resin, 20 parts by weight of a compound represented by the following formula (III), 3 parts by weight of a compound represented by the following formula (IV) and 10 parts by weight of a compound represented by the following formula (V) were added to the silicone resin, and they were sufficiently stirred and mixed to prepare a coating silicone resin. The coating silicone resin was diluted with toluene to obtain a 10% solution as a coating solution.

(I)

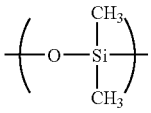

-continued (II)

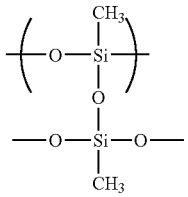

(III)

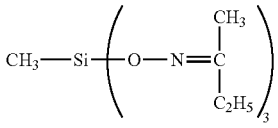

(IV)

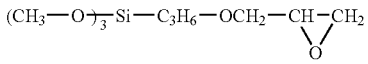

(V)

Then, the carrier core material comprising the ferrite particles was coated with the silicone resin solution by the use of a fluidized bed until the coating amount in terms of a solid became 1.5 parts by weight based on 100 parts by weight of the carrier core material, then dried and baked at 250° C. for 3 hours to prepare a coated carrier (carrier 1).

The coated carrier thus obtained was mixed with commercially available toners (for CF-70, available from Minolta K.K., magenta, cyan, yellow, black) to prepare two-component developing agents each having a toner concentration of 10% by weight. The average particle diameter of each toner was 9.8 μm. The resin component for forming each toner was a polyester resin and contained a salicylic acid-Zn complex as a charging controlling agent.

Composition of the carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. After the printing impression test using the two-component developing agents prepared by the use of the coated carrier, image evaluation (image density, fog, toner fly, carrier adhesion (white spot), halftone uniformity) was carried out, and based on the image evaluation, overall evaluation of the two-component developing agents was carried out. The results are set forth in Table 3.

Magnetic Properties of Carrier Core Material and Coated Carrier.

Magnetic properties of the carrier core material and the coated carrier were measured in the following manner using an integration type B-H tracer (BHU-60 type, manufactured by Riken Denshi Co., Ltd.).

First, a magnetic field was applied to the measuring sample, and the magnetic field was swept to 3000($10^3/4\pi \cdot A/m$). Then, the applied magnetic field was reduced to form a hysteresis loop, and from the hysteresis loop, magnetization, residual magnetization and coercive force at 1000($10^3/4\pi \cdot A/m$) were calculated.

Measurement of Electrical Resistance of Carrier Core Material and Coated Carrier Electrical resistance of the carrier core material and the coated carrier was measured by the use of such an electrical resistance measuring machine as shown in FIG. 1. Referring to FIG. 1, numeral 1 designates a sample (carrier core material, coated carrier), numeral 2 designates a magnetic pole, numeral 3 designates a brass plate, and numeral 4 designates a fluororesin plate.

As shown in FIG. 1, N pole and S pole were allowed to face each other at a magnetic pole distance of 2.0 mm, and 200 mg of a sample was weighed and filled between non-magnetic parallel flat plate electrodes (area: 10×40 mm). The magnetic poles (surface magnetic flux density: 1.5 T, area of facing electrodes: 10×30 mm) were fitted to the parallel flat plate electrodes to hold the sample between the electrodes. Then, electrical resistance of the carrier at an applied voltage of 1000 V was measured by the use of an insulation electrical resistance meter or an ammeter.

Average Particle Diameter of Carrier Core Material and Coated Carrier

An average particle diameter of the carrier core material and the coated carrier was measured by the use of a MICROTRAC particle size analyzer (Model 9320-X100) manufactured by Nikkiso Co., Ltd.

Printing Evaluation

The two-component developing agents obtained were subjected to a printing impression test of 30000 sheets (sometimes referred to as 30 K by representing 1000 sheets by 1 K) using a commercially available apparatus (CF-70, manufactured by Minolta K.K.). Image evaluation (image density, fog, toner fly, carrier adhesion (white spot), halftone uniformity) after the printing impression test and overall evaluation of the two-component developing agents based on the image evaluation are set forth in Table 3. Each item was evaluated and ranked, and the ranks are shown in Table 3. A rank of CC or higher is a level of no problem in practical use. The evaluation methods are as follows.

Image Density

A printed image was output under proper developing bias conditions, and image density of the printed image was evaluated. Specifically, image density of the solid portion was measured by X-Rite (manufactured by Nippon Lithograph, Inc.) and ranked.

AA: The image density is very good.

BB: The image density is in the range of aimed image density.

CC: The image density is somewhat low but serviceable.

DD: The image density is lower than the lower limit of the aimed range.

EE: The image density is extremely low and unserviceable.

Fog

A printed image was output under proper developing bias conditions, and fog density of the printed image was measured by the use of a color difference meter Z-300 A (manufactured by Nippon Denshoku Kogyo K.K.).

AA: The fog density is less than 0.5.

BB: The fog density is not less than 0.5 and less than 1.0.

CC: The fog density is not less than 1.0 and less than 1.5.

DD: The fog density is not less than 1.5 and less than 2.0.

EE: The fog density is not less than 2.0.

Toner Fly

Toner fly in the apparatus was visually observed and ranked.

AA: Toner fly is not observed at all.

BB: Toner fly is observed in a slight amount.

CC: Toner fly on a level of limitation is observed.

DD: Toner fly is observed in a large amount.

EE: Toner fly is observed in an extremely large amount.

Carrier fly

Carrier adhesion or white spots on an image were evaluated.

AA: There is no white spot in 10 sheets of paper of A3 size.

BB: There are 1 to 5 white spots in 10 sheets of paper of A3 size.

CC: There are 6 to 10 white spots in 10 sheets of paper of A3 size.

DD: There are 11 to 20 white spots in 10 sheets of paper of A3 size.,

EE: There are 21 or more white spots in 10 sheets of paper of A3 size.

Halftone Uniformity

A printed image was output under proper developing bias conditions, and uniformity of the halftone portion of the printed image was visually observed and ranked.

AA: The halftone portion is extremely uniform.

BB: The halftone portion is uniform and has no unevenness.

CC: The halftone portion has somewhat unevenness and is on a level of limitation.

DD: The halftone portion has appreciable unevenness and is nonuniform.

EE: The halftone portion has marked unevenness and is nonuniform.

Overall Evaluation

Overall evaluation of the two-component developing agents was carried out based on the image evaluation after the 30 K printing impression test and the printing impression test, and the developing agents were ranked.

AA: Throughout the 30 K printing impression test, an extremely good image is maintained without any change from the initial stage.

BB: Throughout the 30 K printing impression test, there is a little change in each item as compared with the initial stage, but the developing agent is on a good level without any problem in practical use.

CC: Throughout the 30 K printing impression test, there is a change in each item, but the developing agent has no problem in practical use.

DD: Throughout the 30 K printing impression test, there is a great change in each item, and the developing agent is practically unemployable.

EE: From the initial stage of the test, there are some items practically unemployable, or changes in some items are so great that the printing impression of 30 K cannot be achieved.

Example 2

A carrier core material having an average particle diameter of 33.3 μm was prepared in the same manner as in Example 1, except that the composition ratio was changed to that of MnO of 47.5% by mol, MgO of 2.5% by mol and $Fe_2O_3$ of 50.0% by mol, and based on 100 parts by weight of the total of these metal oxides, 0.5 part by weight of $ZrO_2$ and 0.5 part by weight of $Bi_2O_3$ were added. Then, using this carrier core material, a coated carrier (carrier 2) and two-component developing agents were prepared in the same manner as in Example 1.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Example 3

A carrier core material having an average particle diameter of 28.1 μm was prepared in the same manner as in Example 1, except that the composition ratio was changed to that of MnO of 45.0% by mol, MgO of. 5.0% by mol and $Fe_2O_3$ of 50.0% by mol, and based on 100 parts by weight of the total of these metal oxides, 2.5 parts by weight of $ZrO_2$ were added. Then, using this carrier core material, a coated carrier (carrier 3) and two-component developing agents were prepared in the same manner as in Example 1.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation. (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Example 4

Ferrite particles having an average particle diameter of 20.0 μm was prepared in the same manner as in Example 1, except that the composition ratio was changed to that of MnO of 45.0% by mol, MgO of 5.0% by mol and $Fe_2O_3$ of 50.0% by mol, and based on 100 parts by weight of the total of these metal oxides, 4.5 parts by weight of $ZrO_2$ were added. The ferrite particles were used as a carrier core material without subjecting them to oxide coating treatment. The coating resin was prepared as follows. Polymethyl methacrylate. (PMMA) was dissolved in a mixed solution of toluene/methyl ethyl ketone (½) to prepare a 10% solution as a coating solution. The carrier core material comprising the ferrite particles was coated with the PMMA resin coating solution by the use of a kneader until the coating amount in terms of a solid became 1.5 parts by weight based on 100 parts by weight of the carrier core material, then dried and baked at 150° C. for 3 hours to prepare a coated carrier (carrier 4). Then, using the coated carrier (carrier 4), two-component developing agents were prepared in the same manner as in Example 1.

Composition of the resulting carrier core material is set forth in Table 1. Magnetic properties of the carrier core material, electrical resistance thereof, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Example 5

A carrier core material having an average particle diameter of 45.7 μm was prepared in the same manner as in Example 1, except that the composition ratio was changed to that of MnO of 40.0% by mol. MgO of 10.0% by mol and $Fe_2O_3$ of 50.0% by mol, and based on 100 parts by weight of the total of these metal oxides, 1.5 parts by weight of $ZrO_2$ were added. Then, using this carrier core material, a coated carrier (carrier 5) and two-component developing agents were prepared in the same manner as in Example 1.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 1

A carrier core material having an average particle diameter of 26.8 μm was prepared in the same manner as in Example 3, except that only metal oxides of MnO of 45.0% by mol, MgO of 5.0% by mol and $Fe_2O_3$ of 50.0% by mol were used and no other additives were added. Then, using this carrier core material, a coated carrier (carrier 6) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 2

A carrier core material having an average particle diameter of 27.2 μm was prepared in the same manner as in Example 3, except that metal oxides of MnO of 45.0% by mol, MgO of 5.0% by mol and $Fe_2O_3$ of 50.0% by mol were used, and based on 100 parts by weight of the total of these metal oxides, 2.5 parts by weight of $Bi_2O_3$ were added instead of $ZrO_2$. Then, using this carrier core material, a coated carrier (carrier 7) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component, developing agents based on the image evaluation are set forth in Table 3.

Comparative Example 3

A carrier core material having an average particle diameter of 28.4 μm was prepared in the same manner as in Example 3, except that metal oxides of MnO of 45.0% by mol, MgO of 5.0% by mol and $Fe_2O_3$ of 50.0% by mol were used, and based on 100 parts by weight of the total of these metal oxides, 2.5 parts by weight of $Li_2O$ were added instead of $ZrO_2$. Then, using this carrier core material, a coated carrier (carrier 8) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 4

A carrier core material having an average particle diameter of 28.6 μm was prepared in the same manner as in Example 3, except that metal oxides of MnO of 45.0% by mol, MgO of 5.0% by mol and $Fe_2O_3$ of 50.0% by mol were used, and based on 100 parts by weight of the total of these metal oxides, 2.5 parts by weight of $P_2O_5$ were added instead of $ZrO_2$. Then, using this carrier core material, a coated carrier (carrier 9) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 5

A carrier core material having an average particle diameter of 32.5 μm was prepared in the same manner as in Example 3, except that metal oxides of MnO of 4.5.0% by mol, MgO of 5.0% by mol and $Fe_2O_3$ of 50.0% by mol were used, and based on 100 parts by weight of the total of these metal oxides, 2.5 parts by weight of $V_2O_5$ were added instead of $ZrO_2$. Then, using this carrier core material, a coated carrier (carrier 10) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 6

A carrier core material having an average particle diameter of 29.1 μm was prepared in the same manner as in Example 3, except that metal oxides of MnO of 45.0% by mol, MgO of 5.0% by mol and $Fe_2O_3$ of 50.0% by mol were used, and based on 100 parts by weight of the total of these metal oxides, 2.5 parts by weight of SrO were added instead of $ZrO_2$. Then, using this carrier core material, a coated carrier (carrier 11) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 7

A carrier core material having an average particle diameter of 32.0 μm was prepared in the same manner as in Example 3, except that metal oxides of MnO of 45.0% by mol, MgO of 5.0% by mol and. $Fe_2O_3$ of 50.0% by mol were used, and based on 100 parts by weight of the total of these metal oxides, 2.5 parts by weight of CaO were added instead of $ZrO_2$. Then, using this carrier core material, a coated carrier (carrier 12) and two-component developing agents were prepared in the same manner as in Example 3.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 8

A carrier core material having an average particle diameter of 48.1 μm was prepared in the same manner as in Example 5, except that metal oxides of MnO of 40.0% by mol, MgO of 10.0% by mol and $Fe_2O_3$ of 50.0% by mol were used, and based on 100 parts by weight of the total of these metal oxides, 6.0 parts by weight, of $Bi_2O_3$ were added instead of $ZrO_2$. Then, using this carrier core material, a coated carrier (carrier 13) and two-component developing agents were prepared in the same manner as in Example 5.

Composition of the resulting carrier core material is set forth in Table 1. Magnetic properties of the carrier core material, electrical resistance thereof in each step, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

Comparative Example 9

A carrier core material having an average particle diameter of. 20.3 μm was prepared in the same manner as in Example 4, except that the composition ratio of metal oxides was changed to that of MnO of 25.0% by mol, MgO of 25.0% by mol and $Fe_2O_3$ of 50.0% by mol, and based on 100 parts by weight of the total of these metal oxides, 0.5 part by weight of $Bi_2O_3$ and 0.5 part by weight of SrO were added. Then, using this carrier core material, a coated carrier (carrier 14) and two-component developing agents were prepared in the same manner as in Example 4.

Composition of the resulting carrier core material is set forth in Table 1. Magnetic properties of the carrier core material, electrical resistance thereof, and average particle diameter, 635-mesh passing ratio, electrical resistance and magnetic properties of the coated carrier are set forth in Table 2. Image evaluation (image density, fog, toner fly, carrier adhesion (white spot), halftone uniformity) after the printing impression test using the two-component developing agents prepared by the use of the coated carrier, and overall evaluation of the two-component developing agents based on the image evaluation are set forth in Table 3.

TABLE 1

| | | Composition of ferrite | | | | | | | | | |
|---|---|---|---|---|---|---|---|---|---|---|---|
| | | Composition of main ferrite | | | Additives (wt. part(s) based on 100 wt. parts of ferrite) | | | | | | |
| | | MnO (mol %) | MgO (mol %) | $Fe_2O_3$ (mol %) | $ZrO_2$ (wt. part(s)) | $Bi_2O_3$ (wt. part(s)) | $Li_2O$ (wt. part(s)) | $P_2O_5$ (wt. part(s)) | $V_2O_5$ (wt. part(s)) | SrO (wt. part(s)) | CaO (wt. part(s)) |
| Ex. 1 | carrier 1 | 49.9 | 0.1 | 50.0 | 1.5 | 0.5 | — | — | — | — | — |
| Ex. 2 | carrier 2 | 47.5 | 2.5 | 50.0 | 0.5 | 0.5 | — | — | — | — | — |
| Ex. 3 | carrier 3 | 45.0 | 5.0 | 50.0 | 2.5 | — | — | — | — | — | — |
| Ex. 4 | carrier 4 | 45.0 | 5.0 | 50.0 | 4.5 | — | — | — | — | — | — |
| Ex. 5 | carrier 5 | 40.0 | 10.0 | 50.0 | 1.5 | — | — | — | — | — | — |
| Comp. Ex. 1 | carrier 6 | 45.0 | 5.0 | 50.0 | — | — | — | — | — | — | — |
| Comp. Ex. 2 | carrier 7 | 45.0 | 5.0 | 50.0 | — | 2.5 | — | — | — | — | — |
| Comp. Ex. 3 | carrier 8 | 45.0 | 5.0 | 50.0 | — | — | 2.5 | — | — | — | — |
| Comp. Ex. 4 | carrier 9 | 45.0 | 5.0 | 50.0 | — | — | — | 2.5 | — | — | — |
| Comp. Ex. 5. | carrier 10 | 45.0 | 5.0 | 50.0 | — | — | — | — | 2.5 | — | — |
| Comp. Ex. 6 | carrier 11 | 45.0 | 5.0 | 50.0 | — | — | — | — | — | 2.5 | — |
| Comp. Ex. 7 | carrier 12 | 45.0 | 5.0 | 50.0 | — | — | — | — | — | — | 2.5 |
| Comp. Ex. 8 | carrier 13 | 40.0 | 10.0 | 50.0 | — | 6.0 | — | — | — | — | — |
| Comp. Ex. 9 | carrier 14 | 25.0 | 25.0 | 50.0 | — | 0.5 | — | — | — | 0.5 | — |

TABLE 2

| | | Properties of carrier core material | | | | | | | | |
|---|---|---|---|---|---|---|---|---|---|---|
| | | Carrier core material | | | | Oxide coating treatment | | | Resin coating Coating treatment Coating resin | |
| | | Magnetic properties (at 1000 ($10^3/4\pi \cdot$ A/m) | | | Electrical resistance (at 1000 V) (Ω) | made/not made | Electrical resistance (at 1000 V) (Ω) | Average particle diameter (μm) | Type | Coating amount (wt. %) |
| | | Ms ($Am^2$/kg) | Mr ($Am^2$/kg) | Hc ($10^3/4\pi \cdot$ A/m) | | | | | | |
| Ex. 1 | carrier 1 | 75 | 2 | 12 | $8.0 \times 10^6$ | made | $6.0 \times 10^7$ | 32.9 | Silicone | 1.5 |
| Ex. 2 | carrier 2 | 77 | 1 | 7 | $2.2 \times 10^7$ | made | $2.5 \times 10^8$ | 33.3 | Silicone | 1.5 |
| Ex. 3 | carrier 3 | 69 | 2 | 12 | $5.8 \times 10^5$ | made | $7.0 \times 10^6$ | 28.1 | Silicone | 1.5 |
| Ex. 4 | carrier 4 | 67 | 2 | 12 | $2.0 \times 10^6$ | not made | — | 20.0 | PMMA | 1.5 |
| Ex. 5 | carrier 5 | 66 | 2 | 12 | $9.0 \times 10^7$ | made | $9.8 \times 10^8$ | 45.7 | Silicone | 1.5 |

TABLE 2-continued

| | | | | | | | | | | |
|---|---|---|---|---|---|---|---|---|---|---|
| Comp. Ex. 1 | carrier 6 | 69 | 2 | 12 | $2.5 \times 10^3$ | made | $1.2 \times 10^4$ | 26.8 | Silicone | 1.5 |
| Comp. Ex. 2 | carrier 7 | 62 | 2 | 12 | $4.0 \times 10^5$ | made | $2.8 \times 10^6$ | 27.2 | Silicone | 1.5 |
| Comp. Ex. 3 | carrier 8 | 54 | 3 | 18 | $1.0 \times 10^6$ | made | $2.2 \times 10^7$ | 28.4 | Silicone | 1.5 |
| Comp. Ex. 4 | carrier 9 | 60 | 2 | 12 | $1.8 \times 10^3$ | made | $1.0 \times 10^4$ | 28.6 | Silicone | 1.5 |
| Comp. Ex. 5 | carrier 10 | 65 | 2 | 12 | $1.0 \times 10^3$ | made | $9.0 \times 10^3$ | 32.5 | Silicone | 1.5 |
| Comp. Ex. 6 | carrier 11 | 63 | 4 | 20 | $6.8 \times 10^3$ | made | $7.9 \times 10^4$ | 29.1 | Silicone | 1.5 |
| Comp. Ex. 7 | carrier 12 | 59 | 3 | 18 | $9.8 \times 10^3$ | made | $9.8 \times 10^4$ | 32.0 | Silicone | 1.5 |
| Comp. Ex. 8 | carrier 13 | 51 | 5 | 25 | $7.0 \times 10^5$ | made | $8.9 \times 10^6$ | 48.1 | Silicone | 1.5 |
| Comp. Ex. 9 | carrier 14 | 59 | 3 | 18 | $3.6 \times 10^4$ | not made | — | 20.3 | PMMA | 1.5 |

| | Properties of coated carrier after resin coating Coated carrier | | | | | |
|---|---|---|---|---|---|---|
| | Average particle diameter (μm) | 635-Mesh passing ratio (wt. %) | Electrical resistance (at 1000 V) (Ω) | Magnetic properties (at 1000( $10^3/4\pi \cdot$ A/m) Ms ($Am^2$/kg) | Mr ($Am^2$/kg) | Hc ($10^3/4\pi \cdot$ A/m) |
| Ex. 1 | 35.3 | 1.0 | $6.0 \times 10^{10}$ | 75 | 2 | 12 |
| Ex. 2 | 35.2 | 0.1 | $6.0 \times 10^{11}$ | 77 | 1 | 7 |
| Ex. 3 | 30.0 | 3.0 | $9.8 \times 10^9$ | 69 | 2 | 12 |
| Ex. 4 | 21.0 | 9.2 | $6.7 \times 10^8$ | 68 | 2 | 12 |
| Ex. 5 | 48.0 | 0.1 | $1.2 \times 10^{12}$ | 66 | 2 | 12 |
| Comp. Ex. 1 | 29.8 | 3.2 | $6.4 \times 10^6$ | 69 | 2 | 12 |
| Comp. Ex. 2 | 29.9 | 3.1 | $1.0 \times 10^9$ | 62 | 2 | 12 |
| Comp. Ex. 3 | 30.2 | 2.9 | $5.9 \times 10^{10}$ | 54 | 3 | 18 |
| Comp. Ex. 4 | 31.2 | 3.2 | $5.8 \times 10^6$ | 60 | 2 | 12 |
| Comp. Ex. 5 | 35.6 | 2.1 | $2.8 \times 10^6$ | 65 | 2 | 12 |
| Comp. Ex. 6 | 32.2 | 3.4 | $3.2 \times 10^7$ | 63 | 4 | 20 |
| Comp. Ex. 7 | 35.1 | 3.1 | $5.8 \times 10^7$ | 59 | 3 | 18 |
| Comp. Ex. 8 | 50.0 | 0.2 | $3.2 \times 10^9$ | 51 | 5 | 25 |
| Comp. Ex. 9 | 21.0 | 11.0 | $9.0 \times 10^6$ | 59 | 3 | 18 |

TABLE 3

| | | Image evaluation | | | | | |
|---|---|---|---|---|---|---|---|
| | | Image density | Fog | Toner fly | Carrier adhesion (white spot) | Halftone uniformity | Overall evaluation |
| Ex. 1 | carrier 1 | AA | BB | AA | AA | AA | AA |
| Ex. 2 | carrier 2 | AA | AA | AA | AA | AA | AA |
| Ex. 3 | carrier 3 | BB | BB | BB | BB | BB | BB |
| Ex. 4 | carrier 4 | AA | CC | CC | CC | BB | CC |
| Ex. 5 | carrier 5 | CC | BB | BB | CC | CC | CC |
| Comp. Ex. 1 | carrier 6 | BB | EE | EE | DD | CC | DD |
| Comp. Ex. 2 | carrier 7 | CC | CC | CC | DD | DD | DD |
| Comp. Ex. 3 | carrier 8 | DD | CC | CC | EE | CC | DD |
| Comp. Ex. 4 | carrier 9 | BB | EE | EE | EE | DD | EE |
| Comp. Ex. 5 | carrier 10 | BB | EE | EE | DD | DD | EE |
| Comp. Ex. 6 | carrier 11 | BB | DD | DD | DD | EE | DD |
| Comp. Ex. 7 | carrier 12 | BB | DD | DD | EE | EE | EE |
| Comp. Ex. 8 | carrier 13 | DD | CC | CC | EE | DD | DD |
| Comp. Ex. 9 | carrier 14 | BB | EE | EE | EE | DD | EE |

What is claimed is:

1. A carrier core material for an electrophotographic developing agent, comprising ferrite particles containing a ferrite component represented by the following formula (A):

$$(MnO)_x(MgO)_y(Fe_2O_3)_z \quad (A)$$

wherein x, y and z are each expressed in % by mol and are numbers satisfying the conditions of $40 \leqq x \leqq 60$, $0.1 \leqq y \leqq 10$ and $x+y+z=100$, and $ZrO_2$ in an amount of 0.01 to 5.0 parts by weight based on 100 parts by weight of the ferrite component, said $ZrO_2$ not forming a solid solution with the ferrite component and said $ZrO_2$ is finely dispersed in the ferrite component, wherein the carrier core material has a magnetization, at $1000(10^3/4\pi \cdot A/m)$, of 65 to 85 $Am^2/kg$ and an electrical resistance, at an applied voltage of 1000 V, of $10^5$ to $10^9$ Ω.

2. The carrier core material for an electrophotographic developing agent as claimed in claim 1, wherein the ferrite particles further contain $Bi_2O_3$ in an amount of 0.1 to 5.0 parts by weight.

3. The carrier core material for an electrophotographic developing agent as claimed in claim 1, wherein the surfaces of the ferrite particles have been oxidized.

4. The carrier core material for an electrophotographic developing agent as claimed in claim 3, wherein the ferrite particles having oxide layers on their surfaces have an electrical resistance, at an applied voltage of 1000 V, of $10^6$ to $10^{12}$ Ω.

5. A coated carrier comprising:

a carrier core material which comprises ferrite particles containing a ferrite component represented by the following formula (A):

$$(MnO)_x(MgO)_y(Fe_2O_3)_z \quad (A)$$

wherein x, y and z are each expressed in % by mol and are numbers satisfying the conditions of $40 \leqq x \leqq 60$, $0.1 \leqq y \leqq 10$ and $x+y+z=100$, and $ZrO_2$ in an amount of 0.01 to 5.0 parts by weight based on 0.100 parts by weight of the ferrite component, said $ZrO_2$ not forming a solid solution with the ferrite component and said $ZrO_2$ is finely dispersed in the ferrite component, and a resin coating layer formed on the surface of the core material, wherein the coated carrier has a magnetization, at 1000 $(10^3/4\pi \cdot A/m)$, of 65 to 85 $Am^2/kg$ and an electrical resistance, at an applied voltage of 1000 V, of not less than $10^7$ Ω.

6. The coated carrier as claimed in claim 5, wherein the ferrite particles further contain $Bi_2O_3$ in an amount of 0.1 to 5.0 parts by weight.

7. The coated carrier as claimed in claim 6, wherein the ferrite particles have oxide layers on their surfaces and have an electrical resistance, at an applied voltage of 1000 V, of $10^6$ to $10^{12}$ Ω.

8. The coated carrier as claimed in claim 5, wherein the carrier core material is coated with a resin in an amount of 0.01 to 10 parts by weight based on 100 parts by weight of the carrier core material.

9. The coated carrier as claimed claim 5, having an electrical resistance, at an applied voltage of 1000 V, of $10^7$ to $10^{13}$ Ω.

10. The coated carrier as claimed in claim 5, wherein the coated carrier has an average particle diameter of 20 to 50 μm and a 635-mesh passing ratio of not more than 10% by weight.

11. The coated carrier as claimed in claim 5, having a residual magnetization (Mr), at $1000(10^3/4\pi \cdot A/m)$, of not more than 5 $Am^2/kg$, and a coercive force (Hc) of not more than $20(10^3/4\pi \cdot A/m)$.

12. A two-component developing agent for electrophotography, comprising, the coated carrier of claim 5 and toner particles having an average particle diameter of 3 to 15 μm.

13. An image forming method comprising developing an electrostatic latent image formed by the use of an alternating electric field, with the two-component developing agent for electrophotography of claim 12.

* * * * *

UNITED STATES PATENT AND TRADEMARK OFFICE

CERTIFICATE OF CORRECTION

PATENT NO. : 7,183,033 B2
APPLICATION NO. : 10/774045
DATED : February 27, 2007
INVENTOR(S) : Shinmura et al.

It is certified that error appears in the above-identified patent and that said Letters Patent is hereby corrected as shown below:

Column 29, Line 42, Claim 5, "0.100 parts by weight" should read
-- 100 parts by weight --

Signed and Sealed this

Nineteenth Day of June, 2007

JON W. DUDAS
*Director of the United States Patent and Trademark Office*